US005427545A

United States Patent [19]

Kourimsky et al.

[11] Patent Number: 5,427,545

[45] Date of Patent: Jun. 27, 1995

[54] INSULATION DISPLACEMENT ELECTRICAL TERMINAL ASSEMBLY

[75] Inventors: Friedrich J. A. Kourimsky, Bensheim; Gheorghe Hotea, Griesheim, both of Germany

[73] Assignee: The Whitaker Corporation, Wilmington, Del.

[21] Appl. No.: 197,414

[22] Filed: Feb. 16, 1994

[30] Foreign Application Priority Data

Feb. 25, 1993 [GB] United Kingdom ..... 9303835

[51] Int. Cl.[6] ..... H01R 4/24

[52] U.S. Cl. ..... 439/397

[58] Field of Search ..... 439/395, 397, 396, 856

[56] References Cited

U.S. PATENT DOCUMENTS

| | | | |
|---|---|---|---|
| Re. 31,132 | 1/1983 | Hoppe, Jr. | 439/397 |
| 4,085,995 | 4/1978 | Kautz | 439/395 |
| 4,241,970 | 12/1980 | Rider, Jr. et al. | 439/856 X |
| 4,557,544 | 12/1985 | Esser | 439/395 X |
| 4,699,441 | 10/1987 | D'Urso et al. | 439/397 |
| 5,030,143 | 7/1991 | Hatagishi | 439/395 X |

FOREIGN PATENT DOCUMENTS

| | | | |
|---|---|---|---|
| 122780 | 10/1984 | European Pat. Off. | 439/395 |
| 152690 | 8/1985 | European Pat. Off. | 439/397 |
| 0233399 | 8/1987 | European Pat. Off. . | |
| 279508 | 8/1988 | European Pat. Off. | 439/397 |
| 0372767 | 6/1990 | European Pat. Off. . | |
| 8604746 | 4/1986 | Germany . | |
| 4111054 | 10/1991 | Germany | 439/395 |
| 1026206 | 6/1983 | U.S.S.R. | 437/396 |

*Primary Examiner*—William Briggs

*Attorney, Agent, or Firm*—Eric J. Groen; Driscoll A. Nina; Timothy J. Aberle

[57] ABSTRACT

An electrical terminal assembly comprising an electrical terminal has an insulation displacement contact having a base portion from which extend a pair of coplanar arms defining a slot for receiving an insulated lead. A restraining flange projecting from the top of each arm at right-angles to its plane terminates in a foot which is received in a well in a housing having a cavity receiving the terminal assembly. The well is dimensioned to allow the foot to move parallel to the plane of the arms but not at the right angles thereto. The arms cannot, therefor, twist about their longitudinal axes under the lead insertion force, but can move in their own planes to accommodate the metal cone of the lead as it is forced into the slot.

18 Claims, 5 Drawing Sheets

INSULATION DISPLACEMENT ELECTRICAL TERMINAL ASSEMBLY

BACKGROUND OF THE INVENTION

1. Field of the Invention

This invention relates to an insulation displacement terminal assembly.

2. Description of the Prior Art

There is disclosed in U.S. Pat. No. 4,241,970 an electrical terminal assembly comprising an electrical terminal having an insulation displacement contact comprising a pair of coplanar arms projecting from a base portion and having opposed edges co-operating to define between them, a lead receiving slot opening in a direction away from the base portion.

In this known terminal assembly the base portion of the terminal is supported in a first housing. In order to insert an insulated lead into the lead receiving slot of the terminal, the lead is supported in a second housing having a slot for receiving the arms of the insulation displacement contact, and the first and second housings are mated so that the lead is forced into the lead receiving slot, so that the edges of the slot make firm electrical contact with the metal core of the lead.

It has been found that the natural tendency of the lead core under the lead insertion force is to cause one arm of the insulation displacement contact to move in a direction other than the plane of the plate forming the IDC slot and the other arm of the contact moves in the opposite sense. Such opposite displacement of the arms tends to cause the distance between the edges of the lead receiving slot to increase, thereby impairing the electrical conductivity between the lead core and the insulation displacement contact.

SUMMARY OF THE INVENTION

According to the present invention an electrical terminal assembly as defined in the second paragraph of this application is characterized by a restraining member outstanding from each arm of said insulation displacement contact and having a first end connected to said arm at a position remote from the base portion and a second end anchored to a housing receiving the terminal assembly, or being anchored to a second insulation displacement contact of the assembly; in such a way as to restrain movement of said arm, but so as to permit movement thereof in its own plane.

Thus no housing having a slot for receiving the arms of the insulation displacement contact is needed for loading the terminal assembly with a lead. The lead may, therefore, be forced into the lead receiving slot of the contact by means of conventional tool for that purpose.

According to a first embodiment of the present invention each restraining member comprises an anchoring flange which engages in a well in the housing in which the terminal assembly is received, for movement parallel to the plane of the arm to which the restraining member is connected but being immovable transversely of said plane.

According to a second embodiment of the invention, said second insulation displacement contact extends from the base portion of the terminal in spaced, parallel alignment with the first mentioned insulation displacement contact. A back-up spring cover receiving the terminal and being fixed thereto has a pair of coplanar spring arms parallel to and overlapping the arms of each insulation displacement contact. Each restraining member connects a respective opposed pair of said spring arms and is clinched to the arms of the insulation displacement contact of a respective opposed pair of these arms. Each insulation displacement contact is thereby surrounded by a restraining structure which prevents the arms of the contact from movement in a direction other that the plane of the plate in which the IDC contact is formed.

DETAILED DESCRIPTION OF THE PREFERRED EMBODIMENT

Figure 1:
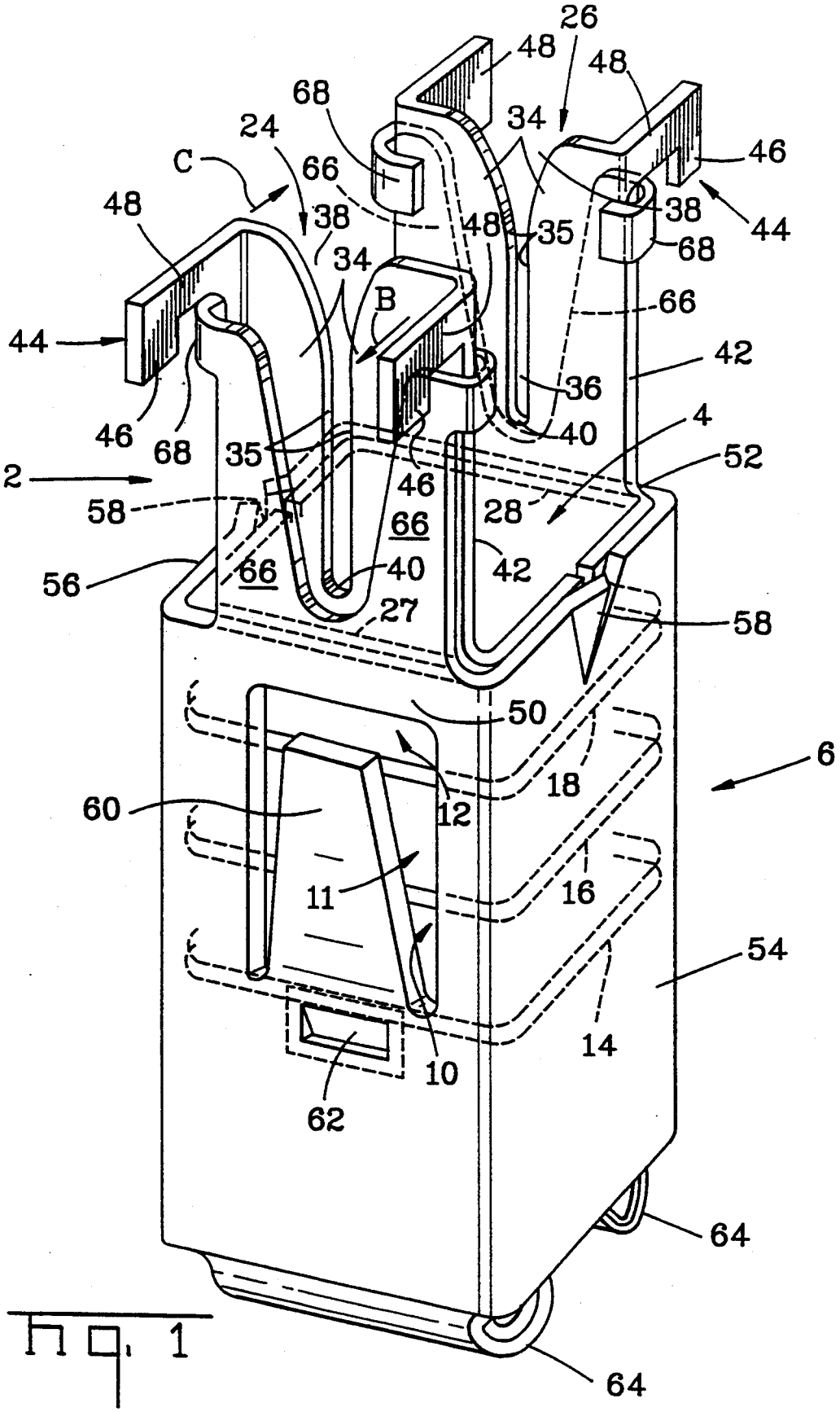
FIG. 1 is an isometric view of an electrical terminal assembly assorting to a first embodiment of the invention.
Figure 2:
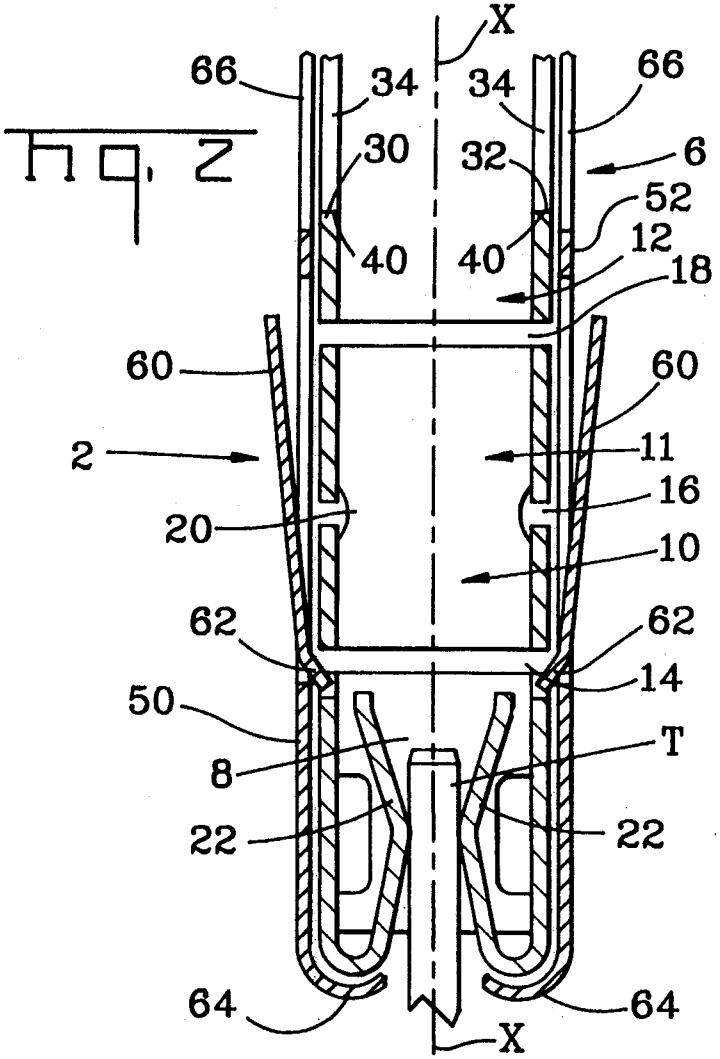
FIG. 2 is a fragmentary longitudinal sectional view of the terminal assembly.

As shown in FIGS. 1 and 2, the electrical terminal assembly 2 according to said first embodiment comprises an inner electrical receptacle terminal 4 and an outer back-up spring cover 6.

As shown in FIG. 2, the terminal 4 which has been stamped and formed from a single piece of sheet metal stock, comprises a tab receptacle portion 8, intermediate body portions 10 and 11, respectively, and a lead connecting portion 12. The portions 8, 10, 11 and 12 are of box-like, substantially rectangular, cross-section. At the ends of the portions 8 and 10, which are proximate to each other side walls of each of the portions 8 and 10 co-operate to defining a peripheral slot 14. At the ends of the portions 10 and 11, which are proximate to each other three side walls of each of the portions 10 and 11 co-operate to define a peripheral slot 16, and at the ends of the portions 11 and 12, which are proximate to each other, three side walls of each of the portions 11 and 12 co-operate to define a peripheral slot 18. The remaining side wall of the portion 10 is connected to the remaining side wall of the portion 11 by a first web 20, the remaining side wall of each of the portions 8 and 10, being connected by a second and similar web (not shown) and the remaining side wall of each of the portions 11 and 12 being connected by a third and similar web (not shown). The second and third webs are connected to side walls of the portions 10 and 11 opposite to those which are connected by the first web 20. As so for described, the terminal 4 is constructed according to the teaching of British Patent application No 9225855.4 (40087) which is hereby incorporated herein by reference. According to that teaching, the portions 8, 10 and 11 are relatively moveable with respect to the portion 12 about the respective webs, so that the receptacle portion 8 is displaceable in the backing spring cover 6 along the central axis X—X of the terminal assembly 2, to prevent contact springs 22 of the portion 8 from fretting, under the action of vibration, against a tab T when it has been received between the contact springs 22.

The lead connection portion 12 of the terminal 4 comprises a pair of insulation displacement slotted plate contacts 24 and 26, respectively, upstanding from the upper edges 27 and 28, respectively, of opposite side walls 30 and 32 of the lead connection portion 12 of the terminal 4. Each contact 24 and 26 comprises a pair of arms 34 in the form of coplanar plates having inner edges 35 co-operating to define a lead receiving slot 36 having an upwardly flared lead guiding mouth 38 and a base 40. Opposite to its edge 35, each arm 34 has a vertical, laterally outer edge 42 which is surmounted by a restraining member in the form of a planar anchoring flange 44 projecting laterally outwardly of the terminal 4, at right angles to the plane of the arm 34. Each anchoring flange 44 has a downwardly projection anchoring foot 46 connected to the respective lateral edge 82 by way of a horizontal leg 48.

The back up spring cover 6, which has been stamped and formed form a single piece of sheet metal stock, is of rectangular, substantially square cross-section having opposite side walls 50 and 52 and opposite side walls 54 and 56, which co-operate to enclose the box-like portions 8, 10, 11 and 12 of the terminal 4. The side walls 54 and 56 of the cover 6 are clinched at 58 to respective opposite side walls of the lead connection portion 12 of the terminal 4 whereby the cover 6 is fixably attached at its upper end to the portion 12 of the terminal 4. The side walls 50 and 52 of the cover 6 are formed with outwardly and upwardly inclined latching tongues 60 and downwardly and inwardly inclined stop tongues 62 for limiting the upward axial movement of the receptacle portion 8. The side walls 50 and 52 also have served bottom portions 64 which overlie bight portions of the contact spring 22, as shown in FIG. 2 in order to limit downward axial movement of the receptacle portion 8.

There projects form the upper edge of each side wall 50 and 52 of the back-up spring cover 6 a pair of back-up spring arms 66 each of which is surmounted by a laterally outwardly projecting hook portion 68 which has been clinched about the outer edge 42 of a respective arm 34 just below its anchoring flange 44.

Figure 3:
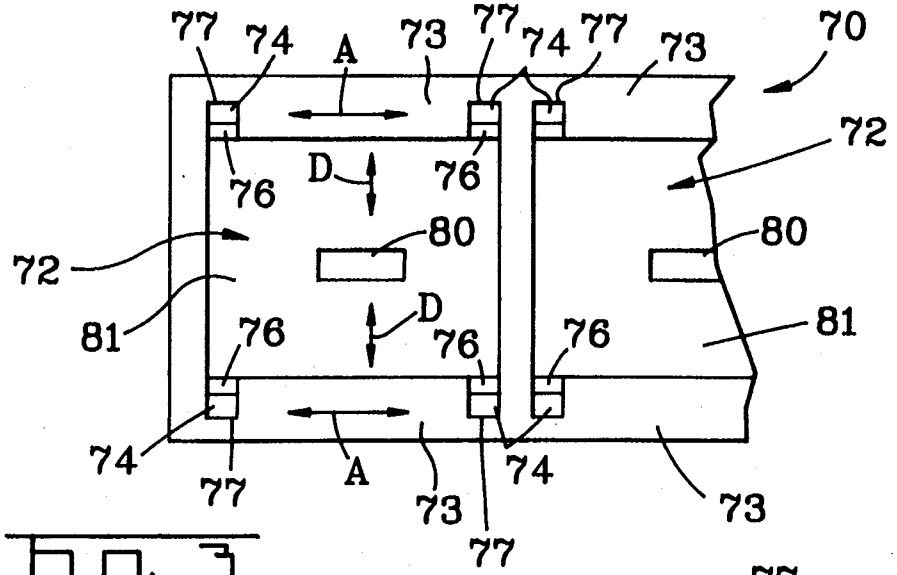
FIG. 3 is a top plan view of one end of an insulating housing for receiving a plurality of the terminal assemblies.
Figure 4:
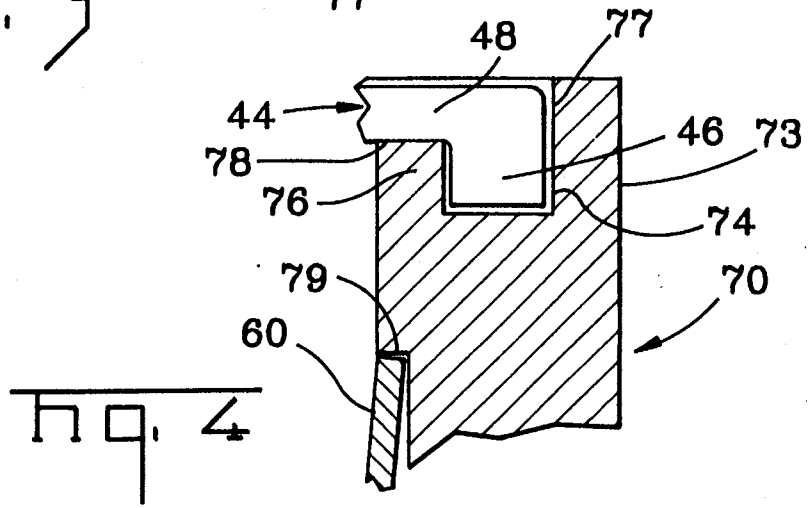
FIG. 4 is a fragmentary sectional view through part of the housing showing parts of the terminal assembly in their relation to the housing when the terminal assembly has been received therein.

As shown in FIG. 3, an insulating housing 70 has substantially square cross-section cavities 72 which are upwardly open, each to receive a respective terminal assembly 2. Proximate to each cavity 72, there open into the top face of each of opposite side walls 73 of the housing 70 a pair of spaced apart wells 74 each for receiving the anchoring foot 46 of a respective anchoring flange 44. The wells 74 of each cavity 72 are arranged proximate to the corners thereof. Between each well 74 and the respective cavity 72 is an anchoring lip having a top face 78 positioned just below the top face of the respective side wall 73. Within each cavity 72, each of the opposite side walls 73 of the housing 70 is formed with a latching shoulder 79 for engagement by the free end surface of a respective latching lance 60, as shown in FIG. 4. The bottom wall 81 of each cavity 72 is formed with a through hole 80 for receiving a respective tab T.

Each terminal assembly 2 is assembled to the housing 70 by inserting the assembly 2 into its respective cavity 72 through the open top thereof, with the curved portions 64 of the assembly 2 leading, with the foot 46 of each anchoring tab 44 aligned with a respective well 74 and the opening between the contact springs 22 aligned with the hole 80 in the bottom wall 81 of the cavity 72. Thus in the fully inserted position of the assembly 2, the foot 46 of each anchoring flange 44 is received in its respective well 74 with the leg 48 of the anchoring flange 44 abutting the top face of the adjacent lip 76, as shown in FIG. 4 and the end face of each latching tongue 60 overlying a respective latching shoulder 78, whereby withdrawal of the assembly 2 from its cavity 72 is prevented. In the fully inserted position of the terminal assembly 2, each insulation displacement contact 24 and 26 is spaced from the respective side wall 73 of the housing 10, by means of its leg 48. The wells 74, and the feet 46 are so relatively dimensioned, that each foot can move laterally in its well 74, that is to say towards and away from the other foot 46 of the same insulation displacement contact, as shown by arrows A in FIG. 3. Since each foot 46 is received within its respective well 74 and confined therein by the respective lip 76 and the wall 77 opposite thereto, as best seen in FIG. 4, movement of the arms 34 is prevented from occurring in the directions of arrow B and arrow C (FIG. 1) and double arrows D (FIG. 3).

Figure 5:
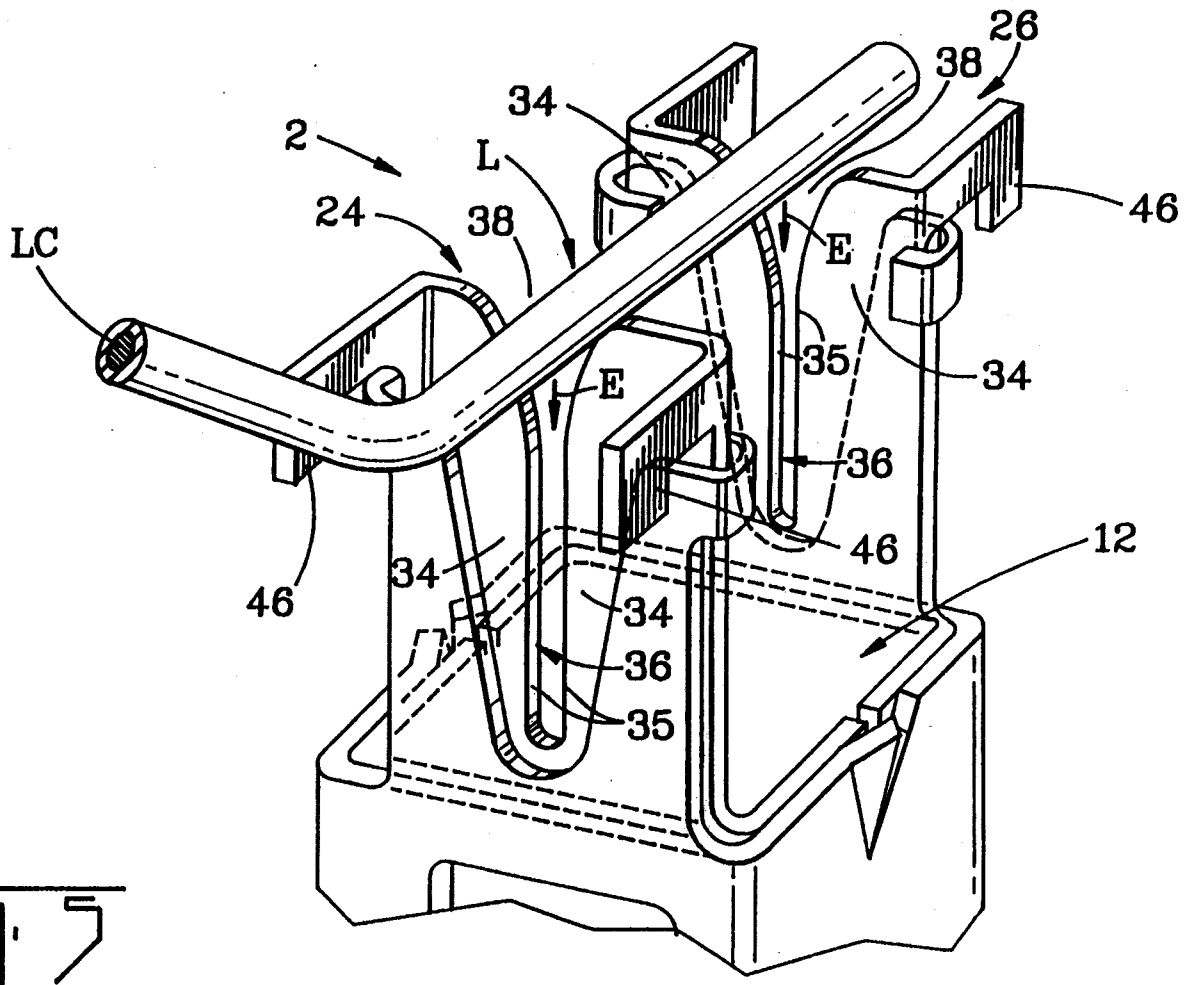
FIG. 5 is a fragmentary isometric view illustrating the connection of an insulated electrical lead to the terminal assembly.

When each terminal assembly 2 has been received in its cavity 72 as described above, an insulated electrical lead L (FIG. 5) is inserted by means of a lead insertion tool (not shown) into the lead receiving slots 36 of the insulation displacement contacts 24 and 26 by way of the lead guiding mouths 38. The lead L is so inserted in a direction at right angles to its length, that is to say in the direction of the arrows E in FIG. 5. As the lead is inserted into the slots 36, the edges 35 thereof displace the insulation of the lead and make firm electrically conducted contact with the central metal core LC of the lead L. The arms 34 of each of the contacts 24 and 26 are forced apart by the core LC of the lead so that the feet 46 move laterally in their wells 74 in the direction of the arrows A in FIG. 3 as described above and the spring arms 66 being deflected in their own planes. Since the feet 46 cannot move in the direction indicated by the arrows D, that is either towards or away from the cavity 72 the arms 34 of each contact 24 and 36 remain in their coplanar relationship so that the edges 35 of each slot 36 remain in facing and aligned relationship with each other, even after the lead L has been fully inserted to a position proximate to the bases 40 of the slots 36, the lead L extending in a direction at right angles to the common plane of the arms 34. The back-up spring arms 66 serve to maintain the contact force between the slot edges 35 and the lead core LC, despite vibration or temperature changes to which the terminal assembly may be subjected when in use. The legs 48, the bottom edges of which engage the top faces 78 of the lips 76 serve to counteract the lead insertion force.

Absent, the provision for retaining the feet 46 against movement in the direction of the arrows D, the natural tendency of the core LC under the lead insertion force would be to cause one arm 34 of each contact 24 or 26 to be torsionally and angularly displaced about its vertical axis either in the sense indicated by the arrow B in FIG. 1 and the other arm 34 to be similarly but oppositely displaced in the sense indicated by the sense indicated by the arrow C in FIG. 1 or vice-versa, given the resilient nature of the back-up spring arms 66. Such angular movement of the arms 34 would cause the lead L to be horizontally angularly displaced in the slots 36 whereby the edges thereof would tend to shear the lead core LC and so reduce its electrical conductivity as will as the tensile strength of the mechanical connections between the core LC and the contact 24 and 26.

The second embodiment of the invention will now be described with particular reference to FIG. 6 in which parts which are the same as corresponding parts which has been described above, bear the same reference numerals thereas and parts which have a similar function to corresponding parts described above bear the same reference numerals thereas but with the addition of a prime symbol.

Figure 6:
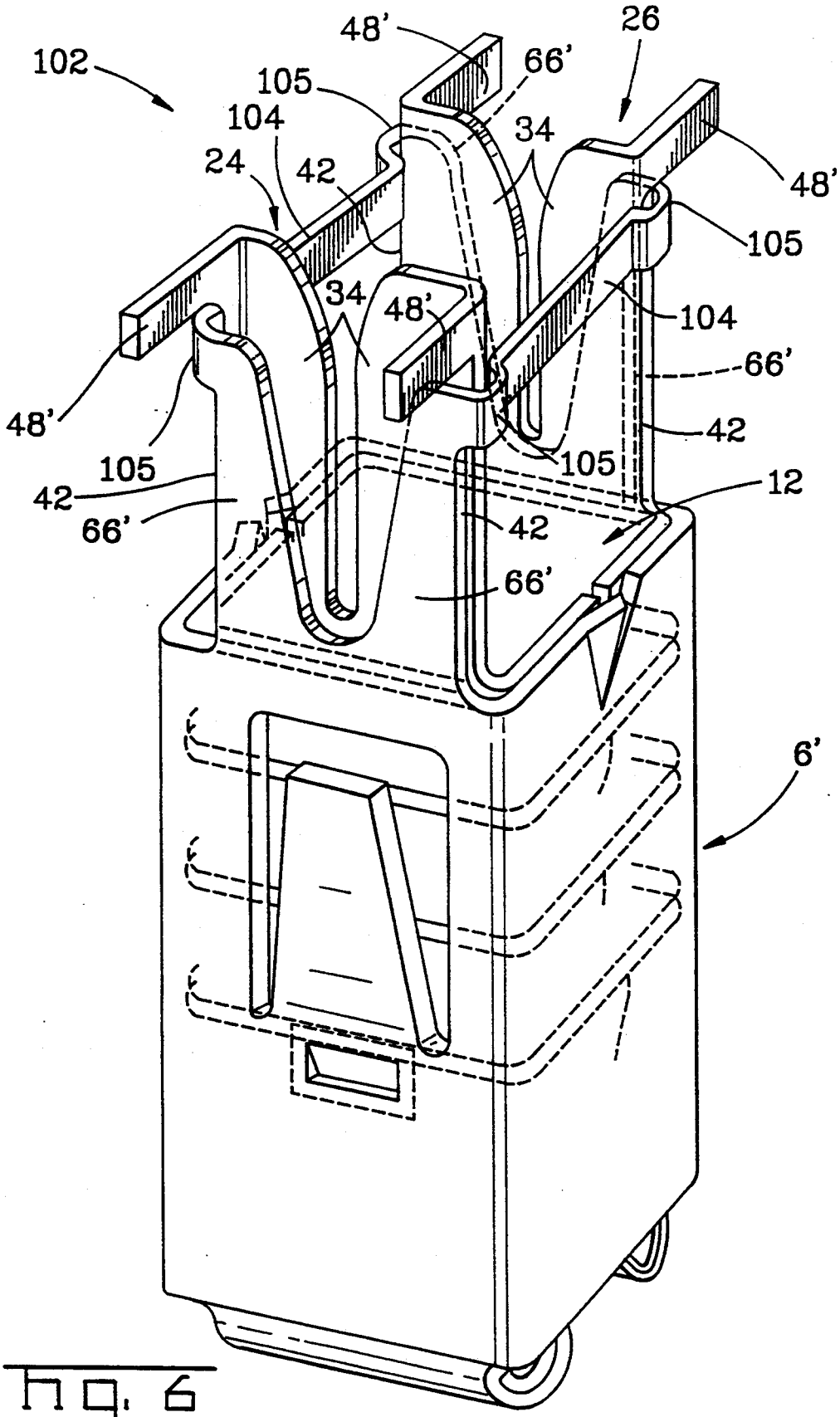
FIG. 6 is an isometric view of an electrical terminal assembly according to a second embodiment of the invention.

The terminal assembly 102 as shown in FIG. 6 is the same as that of the first embodiment, excepting that the feet 46 of the first embodiment have been omitted and the back-up spring arms 66' of the back-up spring cover 6' instead of having hook portions 68 clinched about the outer edges 42 of the arm 34 are connected by means of restraining members in the form of straps 104 extending form their upper ends. Each strap 104 connects a respective back-up spring arm 66' of the insulation displacement contact 24 to the opposite back-up spring arm 66' of the insulation displacement contact 26. The straps 104 are clinched at 105 about the laterally outer edges 42 of the arms 34 of the contacts 24 and 26, just below the legs 48' thereof which are devoid of the feet 46. The straps 104 and the back-up spring arms 66' thus co-operate to provide a box-like structure about the arms 34 so that the angular torsional movement thereof mentioned above is prevented. By virtue of the straps 104, angular torsional movement of the spring arms 66' which would allow similar movement of the arms 34 is prevented. When the assembly 102 is disposed in the cavity 72 of the housing 70, the bottom edges of the legs 48' engage the top faces 78 of the lips 76 and thus counteract the lead insertion force. In this embodiment the wells 74 can be omitted.

Figures 7, 8, 9:
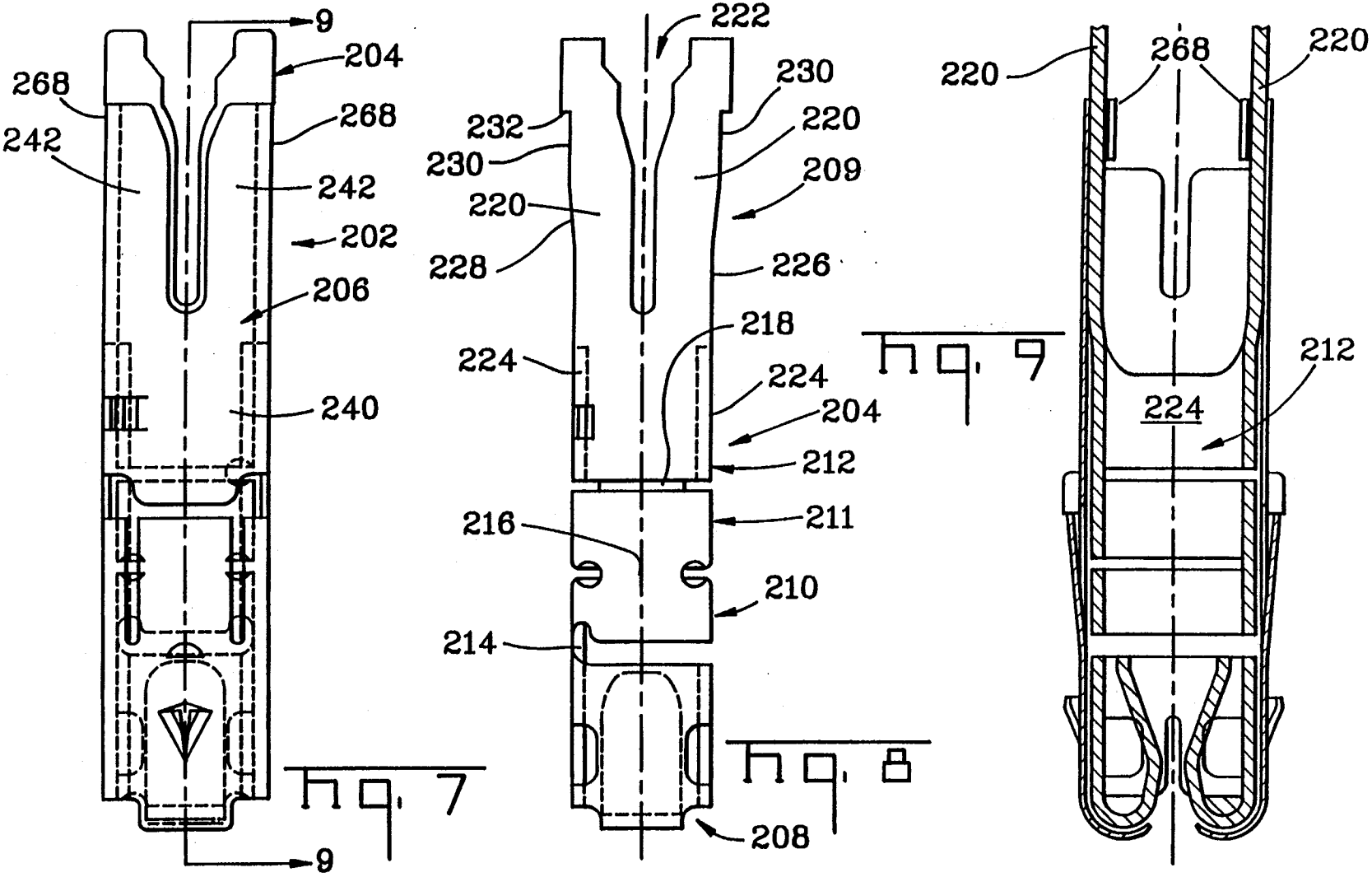
FIG. 7 is a side plan view of an alternate terminal according to the invention.
FIG. 8 is a similar side plan view as that of FIG. 7 showing the back-up spring removed.
FIG. 9 is a cross-sectional view through lines 9—9 of FIG. 7.

With respect now to FIGS. 7–9, an alternate embodiment of the terminal is shown at 202 including an inner contact portion 204 surrounded by an outer backup spring at 206. The inner terminal 204 is shown best in FIG. 8 as including a receptacle portion at 208 interconnected to the wire connecting section 209 via box shaped sections 210,211 and 212. It should be appreciated that the receptacle portion 208 is interconnected to the box shaped portion 210 by way of a web of material at 214. Similarly the box shaped portions 210 and 211 are interconnected to each other by way of a web of material at 216, whereas the box-shaped portions 211 and 212 are interconnected to each other by way of the web of material 218. As shown best in FIG. 8, as the webs of material 214, 216 and 218 are formed from different side walls of the rectangular terminal shaped member 204, the terminal has two degrees of freedom for movement to accommodate for vibratory movement.

The insulation displacement portion 209 is defined by two legs 220 on each side to form a wire receiving slot 222. The leg members 220 upstand beyond a side wall 224 forming the box shaped portion 212 as shown best in FIG. 9. As also shown in FIG. 8, the outer edges of the leg members 220 include edges 226, diverging edges 228 and upper edges 230 forming a stepped end at 232. The outer backup spring 206, shown in FIG. 7, is similar to that shown in FIG. 1, having a rear box portion 240 having upstanding backup arms 242 where the arms include outwardly projecting hook members 268 as shown in FIG. 9. These hook members 268 grip along side edges 230 of the IDC leg portions 220 thereby providing a backup force.

In the preferred embodiment of the invention, the distance between the inner surfaces of the hook portions 268 which engage the side edges 230 of the same slot is less than the distance between the corresponding side edges 230, such that the assembly of the backup spring member 206 over the terminal shown in FIG. 8 forces the leg members 220 towards each other, to preload the insulation displacement slot 222.

We claim:

1. An electrical connector assembly comprising a connector terminal assembly including an electrical terminal having an insulation displacement contact with a pair of arms projecting from a base portion and having opposed edges cooperating to define between them a lead receiving slot opening in a direction away from the base portion, where a restraining member that includes an anchoring flange having a leg connected to said arms and terminating in a foot depending therefrom; and a housing having a cavity wherein the terminal assembly is seated and including wells adjacent the cavity such that the foot of the restraining member is received in the corresponding well in such a way as to restrain torsional movement of said arms, but so as to permit movement thereof in their own plane.

2. An electrical terminal assembly comprising an electrical terminal having a base portion with an insulation displacement contact and comprising a pair of resilient arms projecting from a base portion having opposing edges defining a lead receiving slot opening away from the base portion, a cover affixed to the electrical terminal and a spring arm extending from the cover and along each of the resilient arms having a restraining member overlapping and cooperating with the resilient arm in such a way as to restrain torsional movement of said arm, but so as to permit movement thereof in its own plane.

3. An assembly as claimed in claim 1, characterized in that the leg extends from an outer edge of said arm, said leg and said foot being coplanar and extending at right angles to said arm.

4. An assembly as claimed in claim 1 or 3, characterized in that the housing has a cavity having an open end and receiving said terminal assembly, the well being formed in a surface of the housing bounding the open end thereof, and the leg abutting a lip between the well and the cavity.

5. An assembly as claimed in claim 1, characterized in that the terminal assembly further comprises a back up spring cover receiving the terminal and being fixed thereto, said cover having a pair of coplanar spring arms coplanar with the arms of said insulation displacement contact, each spring arm, being clinched to a respective arm of said insulation displacement contact proximate to the restraining member thereof.

6. An assembly as claimed in claim 1, characterized in that a second insulation displacement contact extends from the base portion of the terminal in spaced, parallel, alignment with the first mentioned insulation displacement contact, the terminal assembly further comprising a back-up spring cover receiving the terminal and being fixed to the base portion, said cover having a pair of coplanar spring arms parallel to, and overlapping the arms of each insulation displacement contact, each restraining member connecting a respective opposed pair of said spring arms and being clinched to the insulation displacement contact arms of a respective opposed pair thereof.

7. An assembly as claimed in claim 6, characterized in that each restraining member is formed integrally with the spring arms of the respective pair of opposed pair of such arms and extends therebetween as a rectilinear strap, each spring arm being closely adjacent to a respective insulation displacement contact arm.

8. An assembly claimed in claim 6 or 7, characterized in that a planar leg extends from an outer edge of each insulation displacement contact arm proximate to a free end thereof remote from the base portion, at right angles to the plane of that arm, the legs of one of the insulation displacement contacts extending in the opposite direction to those of the other insulation displacement contact.

9. An assembly as claimed in claim 8, characterized in that the housing has a cavity having an open end and receiving said terminal assembly, an edge of each of the legs of each insulation displacement contact engaging an abutment surface recessed below a respective surface of the housing, bounding said open end thereof.

10. An assembly as claimed in claim 6 characterized in that said restraining members and said spring arms cooperate to provide a box-like restraining structure about said insulation displacement contacts.

11. An electrical terminal assembly comprising an electrical terminal having an insulation displacement contact comprising a pair of resilient arms projecting from a base portion and having opposed edges cooperating to define between them a lead receiving slot opening away from the base portion characterized in that a back-up spring cover is received upon the terminal and is fixed thereto, said cover having a pair of coplanar spring arms extending parallel to, and overlapping, the resilient arms of the insulation displacement contact, the spring arms including a restraining member to cooperate with the resilient arms so that the resilient arms are constrained in such a way as to restrain torsional movement of said resilient arms, but so as to permit movement thereof in its own plane.

12. The electrical terminal assembly of claim 11, further characterized in that the spring arms include a restraining member clinched to the insulation displacement contact arms of a respective opposed pair thereof.

13. The electrical terminal assembly of claim 12, further characterized in that each of the opposed pair of resilient arms include an outer edge that is located opposite the opposed edge that defines the lead receiving slot, said restraining member being clinched about said outer edge.

14. The electrical terminal assembly of claim 11, further characterized in that the terminal assembly includes a second set of resilient arms defining another lead receiving slot aligned with the other lead receiving slot.

15. The electrical terminal assembly of claim 14, further characterized in that a back-up spring cover is received upon the terminal and is fixed thereto, said cover having a pair of coplanar spring arms corresponding to each pair of resilient arms and extending parallel thereto, and overlapping, the arms of the insulation displacement contact, the spring arms including a restraining member being clinched to the insulation displacement contact arms of a respective opposed pair thereof.

16. The electrical terminal assembly of claim 15, further characterized in that each restraining member is formed integrally with the spring arms of the respective pair of opposed pair of such arms and extends therebetween as a rectilinear strap, each spring arm being closely adjacent to a respective insulation displacement contact arm.

17. The electrical terminal assembly of claim 12, further characterized in that the resilient arms are biased inward towards each other in a preloaded manner by the spring arms.

18. The electrical connector assembly of claim 2, further comprising a second pair of resilient arms defining a second slot aligned with the first slot and wherein the corresponding spring arms are interconnected by a rectilinear strap.

* * * * *